United States Patent [19]

Humphrey

[11] Patent Number: 4,966,079

[45] Date of Patent: Oct. 30, 1990

[54] ICE PENETRATING MOORED MINE

[75] Inventor: Samuel A. Humphrey, Charleton, S.C.

[73] Assignee: The United States of America as represented by the Secretary of the Navy, Washington, D.C.

[21] Appl. No.: 334,667

[22] Filed: Dec. 14, 1981

[51] Int. Cl.[5] ..... F42B 22/44

[52] U.S. Cl. ..... 102/411; 89/1.11; 102/418

[58] Field of Search ..... 114/25, 20 R; 102/406, 102/411, 416–420; 89/1 A

[56] References Cited

U.S. PATENT DOCUMENTS

| | | | |
|---|---|---|---|
| 2,352,226 | 6/1944 | Ronning | 102/406 |
| 2,398,794 | 4/1946 | Maltby | 102/411 |
| 3,017,831 | 1/1962 | Barry | 102/411 |
| 3,180,225 | 4/1965 | Draim | 102/411 X |
| 3,791,296 | 2/1974 | Vogt et al. | 102/406 |
| 3,838,642 | 10/1974 | Shimberg | 102/411 X |
| 4,003,291 | 1/1977 | Vass et al. | 102/411 X |
| 4,274,333 | 6/1987 | Lampton | 102/418 |

*Primary Examiner*—David H. Brown

*Attorney, Agent, or Firm*—Kenneth E. Walden

[57] ABSTRACT

The invention disclosed is an anti-submarine moored mine for penetrating ice. The moored mine has an elongated streamline body with a heavy, strong forward hull structure that constitutes a forward penetrating means and a rearward chamber for housing an air braking means such as a parachute. The intermediate sections of the moored mine contain on specific chamber for housing an explosive means such as a warhead and a separate and distinct chamber for housing an inflatable buoyancy means used to fix the position of the moored mine in the water in the proximity of the target submarine.

14 Claims, 4 Drawing Sheets

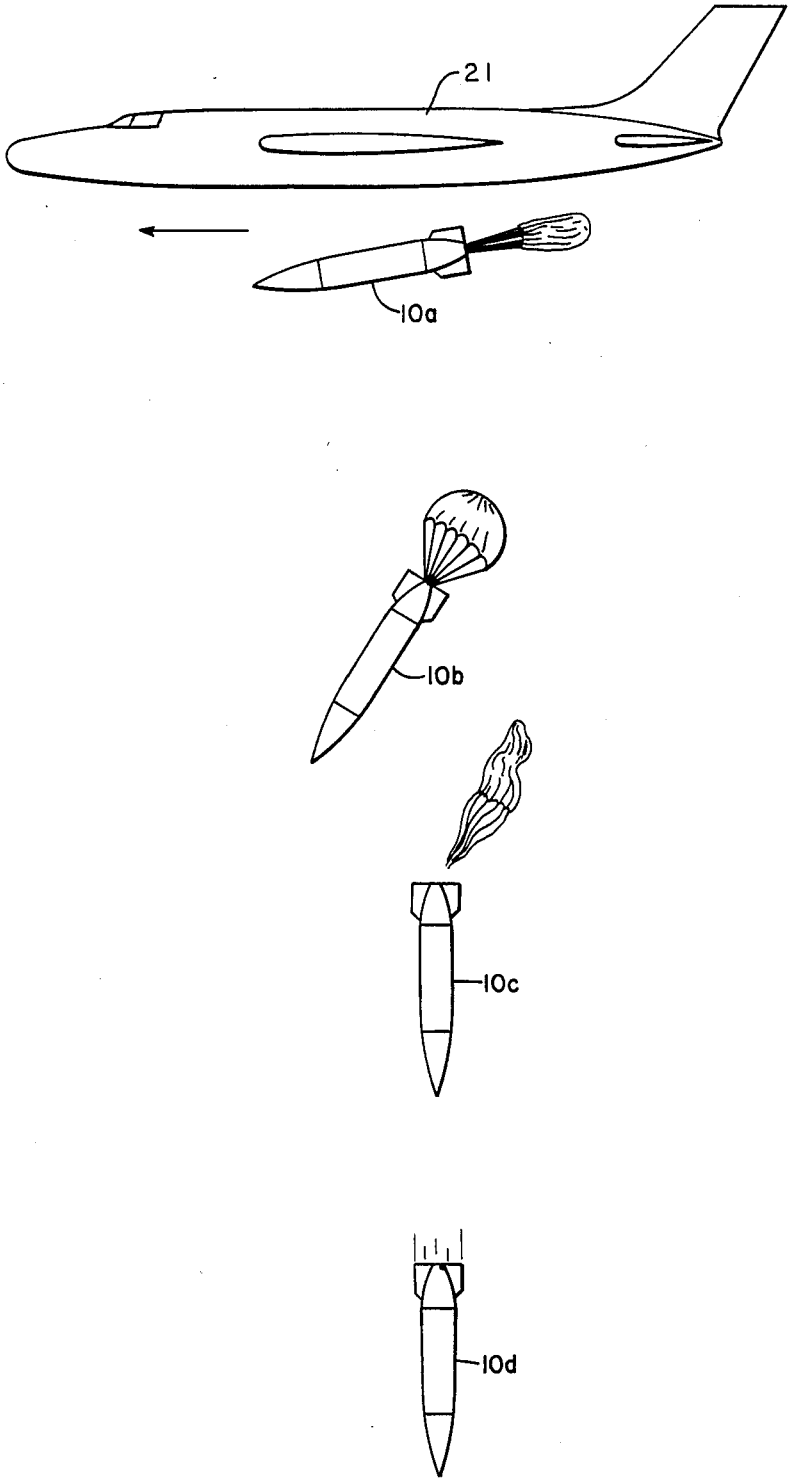
FIG. 4
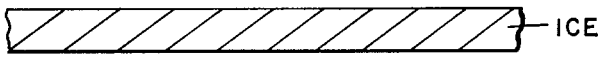

ICE PENETRATING MOORED MINE

BACKGROUND OF THE INVENTION

1. Field of the Invention

The present invention relates to a moored mine that is capable of penetrating from one to ten feet of ice and thereafter ejects and otherwise deploys an inflated means for mooring the mine and a warhead at a fixed position in the water and below the ice so as to intercept and destroy long range submarines that are operating beneath the ice.

2. Description of the Prior Art

Previously, moored mines have never incorporated ice penetration features with automatic means for deploying a moored mine at a fixed distance below an ice field.

For example, U.S. Pat. No. 3,054,371 to Lynch discloses a search torpedo with a means for a self contained power source, a water depth sensor, a bouyancy control device and a target proximity sensor. However, the hull of the torpedo in Lynch would not withstand ice penetration impact and there is no means disclosed to automatically deploy a separate buoyancy control mechanism so as to position the mine a fixed distance below the surface. Likewise, U.S. Pat. No. 3,875,552 to Hogman et al discloses an underwater mobile target with an elongated streamline body that is battery driven. This underwater target does not have any forward hull structure capable of penetrating ice. The patent also fails to show or disclose a separate buoyancy mooring means that can be deployed or ejected when the vessel is at the desired position where it is to be moored in the water. U.S. Pat. No. 3,738,270 to Hargett et al discloses a vertically searching depth bomb-torpedo having a plurality of side looking hydrophones. Again, this patent fails to disclose a rugged, strong, heavy forward weight nose portion used in combination with a self-contained power source, an automatically self-inflatable buoyant mooring member having the desired characteristics and features of the inventive moored mine of this invention.

The present invention overcomes the problems of the prior art devices by providing an ice penetrating moored mine that is relatively simple yet it is highly reliable.

SUMMARY OF THE INVENTION

Briefly, the present invention is an ice penetrating moored mine that is relatively small and simple in operation and yet capable of being delivered to the target area by an airplane, wherein the mine is completely self powered and capable of self mooring at the ultimate target site.

The moored mine of this invention represents a unique combination weapon with new capability.

The unique combination weapon of the invention represents a moored mine with a strong rugged forward hull capable of ice penetration combined with braking means to change the direction from horizontal to vertical trajectory in the air so as to allow proper angle and speed for penetration of ice coupled with independent means for buoying the mine and a payload consisting of a detonatable warhead, all moored in the water at the proper preselected depth beneath the ice.

STATEMENT OF THE OBJECTS OF THE INVENTION

One object of the present invention is to provide a relatively simple ice penetrating moored mine.

Another object of the present invention is to provide a relatively inexpensive moored mine that is capable of penetrating ice from about 1 foot to 10 feet in thickness.

Still another object of the present invention is to provide a moored mine that is capable of penetrating ice in considerable thicknesses and yet has includes the features of self deployment of independent buoyancy means that automatically moors the mine at a preselected depth in the water beneath the ice.

Another object of the invention is to provide a mine moored below the ice that rises to the target by the powerful propulsion provided by a rocket motor.

Other objects and advantages and novel features of the present invention will become apparent from the following detailed description of the invention when considered in conjunction with the accompanying drawings wherein:

BRIEF DESCRIPTION OF THE DRAWINGS

FIG. 4 is a schematic view showing ejection of the mine from an airplane with subsequent deployment stages wherein the mine comes to a vertical entry position for penetrating the ice.

DESCRIPTION OF THE PREFERRED EMBODIMENT

Figure 1:
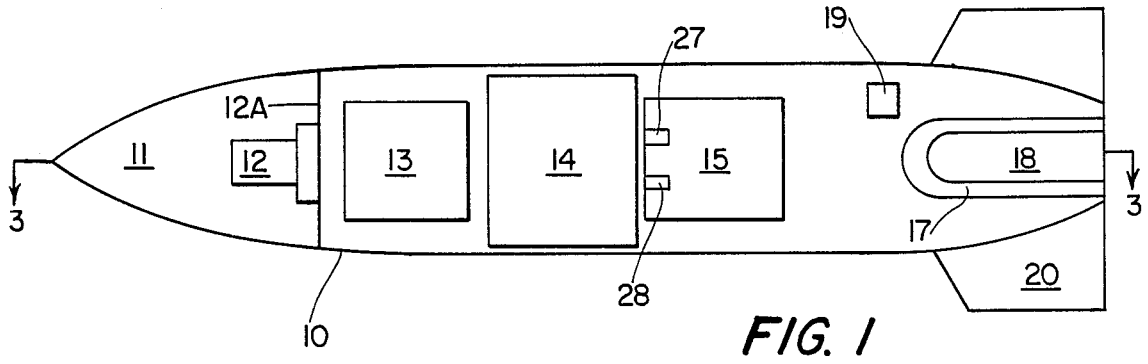
FIG. 1 is a schematic diagram in partial cross section, of the moored mine of this invention.

As illustrated in FIG. 1 the present invention relates to a moored mine for penetrating ice wherein the mine is of a relatively, small, simple configuration and relatively inexpensive to build. The moored mine includes a body 10 with a forward hull section 11 that will, after the mine is deployed become an anchor for the moored mine. A rocket motor 12 is deployed in the rear section of the forward hull or nose 11. In the midsection of the body 10 a cavity 13 houses a warhead or other detonatable explosive means that represents the payload of the moored mine. At or near the rearward section of the body 10 a cavity 14 houses an inflatable buoyancy means such as some type of air or gas balloon 16 or other inflatable device that functions to buoy or moor the mine in the water at the desired distance below the ice field. This balloon is fitted with an automatic air pressurizing mechanism and a source of electrical power such as a standard storage battery. A target sensor or detector device 15 is located at or near the rear of the air balloon. This detector is a device that has automatic means including computer means to automatically fire the warhead 13. At the rearward end of the moored mine an opening 17 forms the housing for an air brake or parachute mechanism 18 that is used to change the trajectory of the mine from the time it is dropped in a horizontal plane from a conventional aircraft, to allow it to come to a completely vertical trajectory prior to making contact with the ice.

In FIG. 1 rocket motor 12 may be controlled by the sensor 15, 29 or other suitable control system such as a target detector. The nose hull 11 is separable from the midsection of the mine along the rearward line near 12A. Warhead 13 is adjacent to a storage area 14 in which a buoyancy means usually a balloon is stored.

Figure 2:
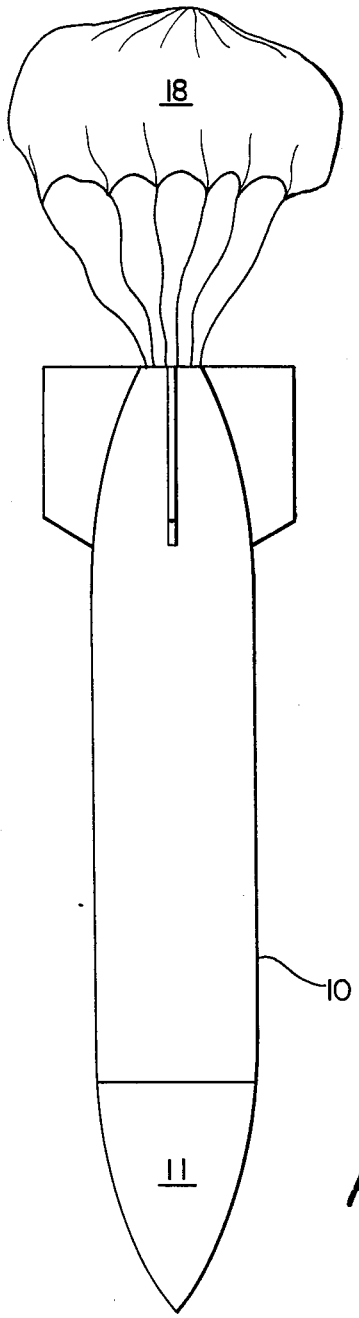
FIG. 2 represents an isometric view of the mine of the instant invention after deployment of the air brake of the parachute.

FIG. 2 is an isometric view to the moored mine of this invention after it has been dropped by a conventional aircraft. The deployment of the parachute or other braking means 18 forces the mine to assume a vertical position. When the mine comes to a substantially vertical position, the mine detaches from the parachute, falls free and gains vertical velocity from free fall so that the heavy nose portion 11 and the entire mine will successfully penetrate an ice field. The ice field may vary in thickness from a few inches thick to as much as ten (10) feet in thickness.

Figure 3:
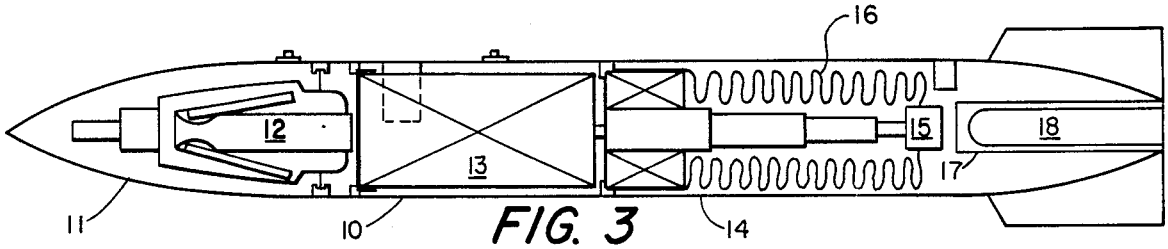
FIG. 3 is a cross section view taken along 3—3 of FIG. 1.

FIG. 3 is a sectional view taken along line 3—3 of FIG. 1. In this view the body 10 supports the nose structure 11, that is fitted with a rearward cavity and houses a rocket motor 12 or other power source means. The air inflated bag or balloon assembly 16 may include a telescoping support mechanism that will be described in more detailed subsequently. The rearward chamber 17 houses a air brake 18 or other parachute like mechanism that is utilize to change the trajectory of the mine from horizontal to vertical.

The parachute or air brake means 18 is released by an automatic timer control mechanism 19 that is set to be initiated upon the dropping and ejection of the mine from the airplane or aircraft. The timer device will cause parachute 18 to deploy at a given time usually from 2 to 10 seconds after the mine is ejected from the aircraft and at some subsequent time usually from 20 to 50 seconds after the parachute is deployed. The timer control will serve as an automatic means to completely release and cut loose the parachute from the mine 10.

In FIG. 2 the mine case or body 10, that is usually made of metal is shown in a vertical position after the air brake or parachute 18 has been deployed for some period of time. In this figure the trajectory of the mine has been changed from horizontal to vertical so that the nose or forward end of the hull 11 is now in position to make penetrating contact with the ice field.

FIG. 3 is a cross sectional view showing the working parts of the mine 10. In FIG. 3 the elongated body of the mine 10, that is usually made of a metallic material such as steel or aluminum or other equivalent material is fitted with a heavy weight, strong forward nose section 11. In the rear of the nose section 11 a cavity accommodates a rocket motor or other propulsion device 12. In the midsection of the mine, a cavity 13 is suitably sized and positioned to allow storage of a large warhead or explosive device of adequate size and strength and detonation capacity to destroy an enemy submarine or other seagoing vessel. In the rearward portion of the mine, a cavity of sufficiently elongation and size is provided within which is stored a buoyancy device 14. The buoyancy means 16 is usually a flat folded, inflatable plastic envelope or balloon of sufficient size to buoy and suspend the mine in the water after it has been submerged to a suitable depth.

In the rearward portions of the mine, storage area or cavity 17 provides an area in which an air brake or parachute 18 is stored while the mine is aboard the aircraft and until such time as the automatic timing control device 19 electrically signals and releases the parachute 18 from the mine. Parachute, or air braking means is utilized to change the trajectory mine from essentially horizontal at the time of ejection from the aircraft to a substantially vertical position.

In FIG. 4 a schematic view, an airplane 21 is shown dropping the mine of this invention. In subsequent stages from top to bottom the mine **10*a*, 10*b*, 10*c* and 10*d* show in a schematic manner the change of trajectory from horizontal to vertical. The function of the parachute 18 is demonstrated in this figure. When the mine is ejected from the airplane in an essentially horizontal position and that within a few seconds the parachute opens, in response to a singal from a timer 19 the trajectory of the mine is then forced to a vertical position as in 10*c*. In position 10*c* the parachute is automatically cut away and released from the mine. After the parachute is released the mine acquires a sufficient velocity, usually in the range of from 150 feet per second to 500 feet per second, from gravity fall so as to obtain adequate velocity to allow the heavy nose cone portion 11** to penetrate an ice field.

Figure 5:
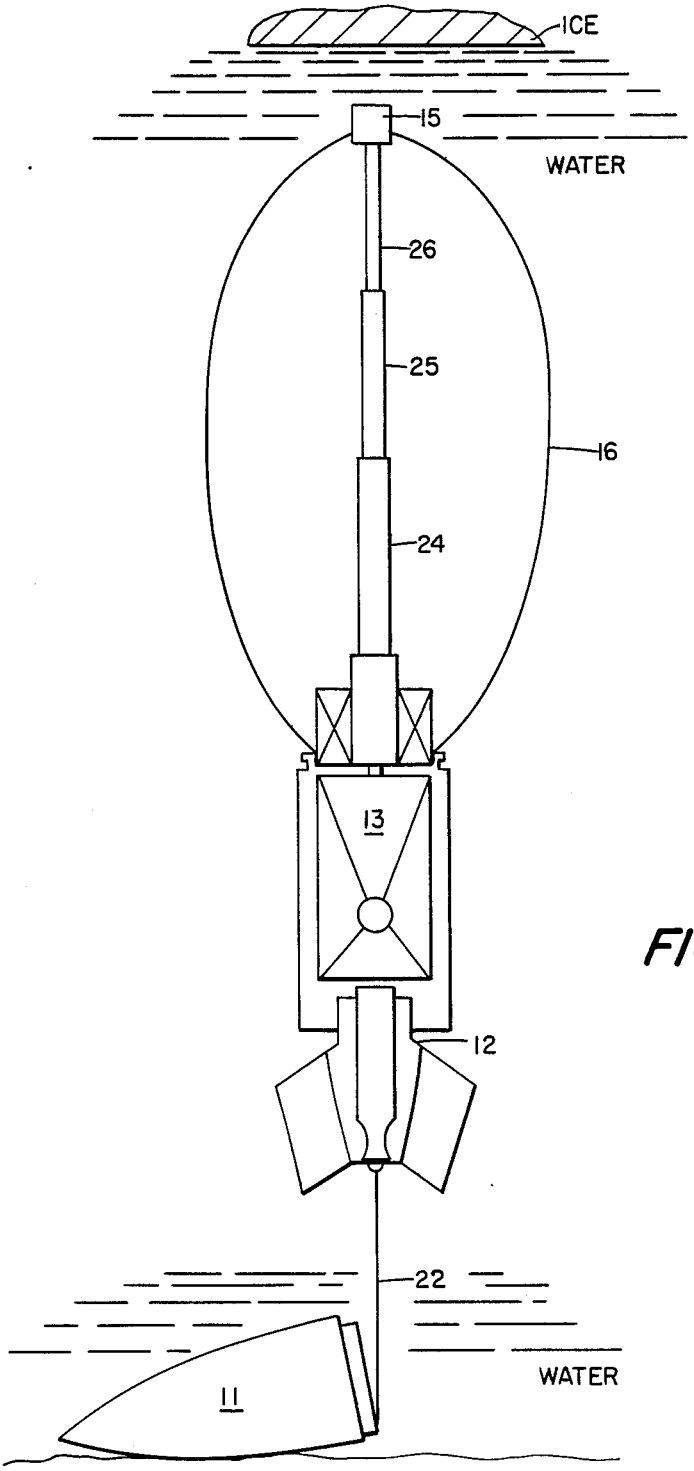
FIG. 5 is a cross section of the mine in a moored position beneath the ice illustrating the buoyed position of the mine, that is anchored by the forward hull of the mine.

In FIG. 5 the mine 10 is depicted in its final position at the floor of the ocean. In this position the detached nose 11 serves as an anchor, wherein an anchor cable 22 connects the nose/anchor means 11 to that midsection of the mine wherein the warhead 13 is housed. In the midsection of the mine 10 the warhead 13 is located with conventional safing and arming means. At the rearward portion of the mine the inflated buoyancy means or balloon 16 is located and physically attached to the midsection of the mine by a cable or other fastener such as a bolt and turnbuckle. The envelope or balloon 16 is inflated by a signal from automatic timer 19. Upon signal from an automatic timer control like 19 the air storage bottle 27 emits air under pressure and inflates balloon 16 thereby forcing balloon 16 out of its housing. The telescopic mast with elements 24, 25 and 26 successively slide out, as air is pumped into the balloon so as to support the balloon at the rearward end of the mine which is now the end of the mine closest to the surface of the water. A target detection device, target detonator or other sensor 15 may be located and supported by the end of telescopic element 26. Other conventional sensors and detonator means, all of which are well known in the mine art may be utilized and mounted on the upper end of the telescopic element 26 and inflated balloon 16.

A 12 volt battery 28 is mounted at or near the base of the inflated balloon serves as a means for supplying electrical current to the timer 19 and to the valve controlling air bottle 27. All components including the air bottle, battery, telescopic mast sensor detonator 29 are well known in the art and are combined to provide a unique result. The penetration of the ice and the location and fixation of the moored mine at a designation position below an ice field by the mine of the invention represents a unique result.

Other equivalent components and mechanisms may be substituted for and utilized in the place of each of the aforesaid elements.

In the preferred embodiment the hull or forward nose portion 11 is made of heavy strong material with very thick walls. Steel or a steel alloy is preferred for nose element 11 and the wall thickness should vary from about 2 inches to about 6 inches. The forward end of nose 11 may be made of hardened steel that is from 2 to 10 inches thick at the extreme forward end.

The propulsion means to move the mine from its moored position to the proximity of an enemy vessel is a conventional rocket motor 12 that can be ignited by an automatic timing device.

The rocket motor is usually fired and ignited by well known controls that are initiated by the target detection device 15.

Figure 6:
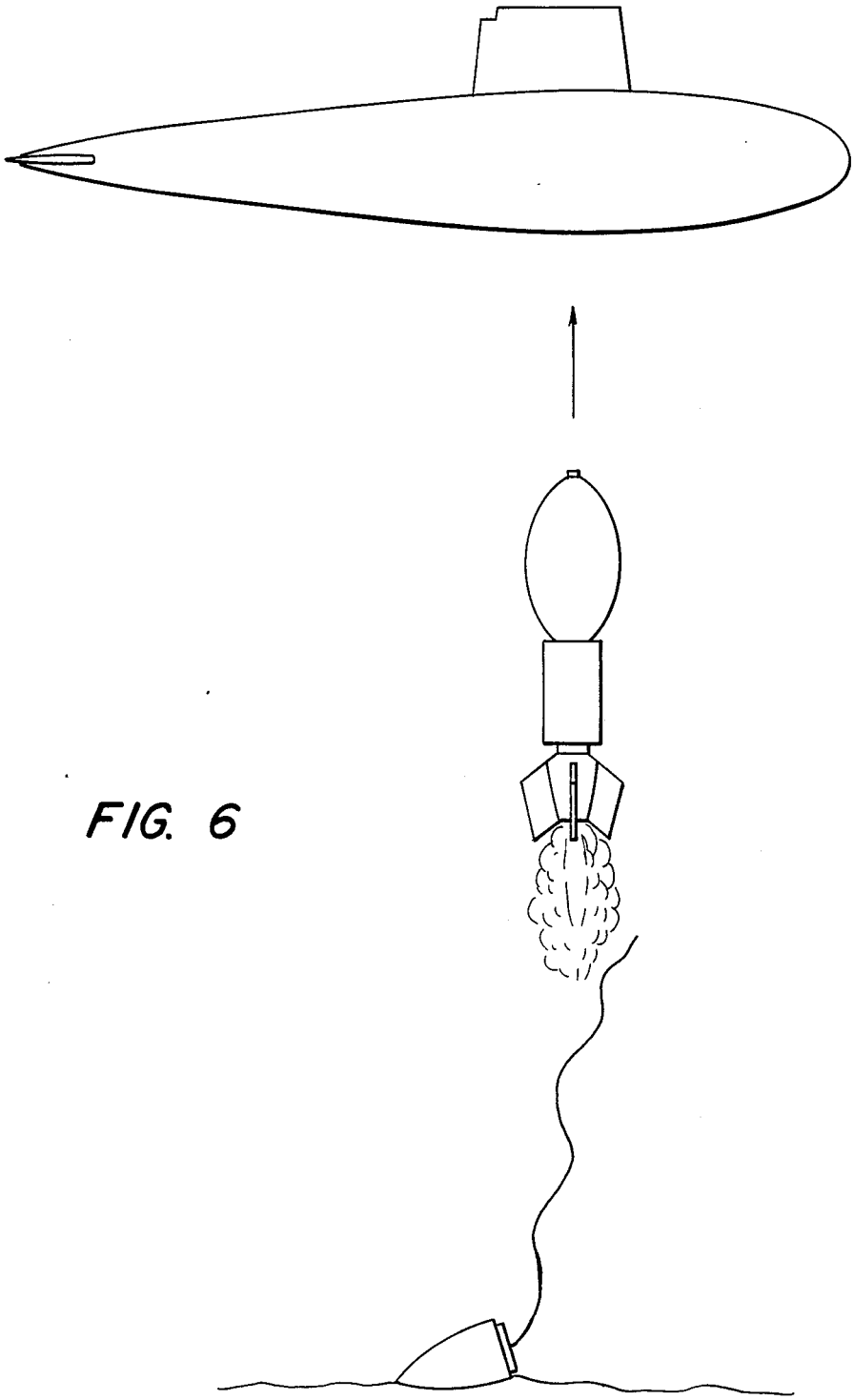
FIG. 6 is a perspective view of a rising mine version of the present invention.

In FIG. 6, that illustrates the rising mine version, the moored mine shown best in FIG. 5, rises by the power supplied by rocket motor 12 to the target in response to an electrical signal given by the target detection device 15 or any equivalent sensor mechanism. This may, of course, include well known acoustic sensors. The sensor or target detection device may also be set to automatically release cable or tether 22. In FIG. 6 the mine rises by propulsion from rocket motor 12.

The sequence of steps in the operation of the moored mine of this invention is as follows:

(1) After the mine is dropped from an airplane an automatic timing device deploys the parachute. The timer is then set to cut the parachute loose and release it from the mine within a period of approximately 20 seconds to 2 minutes, as soon as the trajectory of the mine is substantially vertical.

(2) After the parachute is released it free falls to attain a velocity in the range of 150 to 500 ft per second.

(3) After the mine penetrates the ice the heavy nose 11 will sink to the bottom and is released from the body of the mine 10 by the next signal from the timer. A cable 22 or other equivalent wire or rope tether is used to secure the heavy nose 11 to the body of the mine. The length of cable 22 may be closely regulated so as to moor the mine at a preselected depth below the ice.

(4) Simultaneously or subsequently the balloon 16 is inflated automatically by a signal from an automatic timing device. The signal from the timer released pressurized air from air storage container 27. At that time the telescopic mast sections 25 and 26 are pulled or pushed successively out of section 24 and support the balloon and target detector or other sensor 29.

(5) When a target ship or submarine is detected by sensor 15 the rocket motor 12 is activated and fired. Simultaneously, tether means 22 is released by timer control means 19 and the rocket motor propels the mine into contact or into the proximity of the enemy vessel.

It should be understood that if a vessel comes into close contact or into proximity with the sensor 15 the warhead 14 will be activated and fired automatically without need for the firing of the rocket motor 12.

Obviously, numerous modifications and variations of the present invention are possible in light of the above teaching. It is therefore to be understood that within the scope of the appended claims the invention may be practiced otherwise than as specifically described herein.

What is claimed and desired to be secured by Letters Patent of the United States is:

1. An antisubmarine moored mine for penetrating ice comprising in combination: a forward hull structure having means for penetrating ice and which also functions as an anchor mooring means, a rearward hull structure with an associated air braking means, an intermediate structure housing, a propulsion means, an explosive warhead and an inflatable buoyance means.

2. The moored mine of claim 1 wherein the mine is moored by the anchor means and a tether combination that holds the mine at a predetermined position in the water.

3. The moored mine of claim 2 wherein the tether used to secure the moored mine to the anchor means is automatically released by an electrical signal from a target sensor device located in the intermediate housing

4. The moored mine of claim 1 wherein the bouyancy means comprises an inflatable balloon.

5. The moored mine of claim 4 wherein the balloon is inflated with pressurized air.

6. The moored mine of claim 5 wherein pressurized air is injected into the balloon by means causing an release of air from an air storage container into the balloon.

7. The moored mine of claim 1 wherein the air braking means comprises a parachute.

8. The moored mine of claim 7 wherein the parachute is deployed from the mine by an automatic timing device.

9. The moored mine of claim 8 wherein the automatic timing device provided gives a first signal that deploys the parachute and a second subsequent signal that actuates a release mechanism that cuts away and releases the parachute after the trajectory of the mine has been altered from horizontal to substantially vertical by the use of an air braking means.

10. The moored mine of claim 9 wherein an automatic timing device ignites the propulsion means at a time subsequent to ice penetration by the moored mine.

11. The moored mine of claim 10 wherein the propulsion means comprises a rocket motor.

12. The moored mine of claim 11 wherein the propulsion means is used to move the mine from a moored position to the target.

13. A method of deploying and positioning a mine at a moored position in the water below an ice field comprising the steps of:

(a) dropping an elongated mine with braking means from an airplane, (b) deploying the braking means in a manner to turn the mine to a vertical position so that the alignment of the mine is at a substantially 90° angle to the earth's surface, (c) releasing the braking means so as to allow the mine to freely fall by gravitational pull and to attain a velocity of from about 150 to 500 ft. per second, (d) causing the high velocity mine to strike and penetrate a ice field and to enter the water below the ice, (e) automatically deploying of an anchor and tether means from the mine, (f) automatically deploying an inflatable buoyancy means from the mine that moors the mine, and (g) automatically igniting a warhead by a target sensor.

14. The method of claim 13 wherein the target sensor gives an electrical signal that releases the anchor and tether means and automatically fires a rocket motor to move the mine from the moored position to the immediate proximity of the target where detonation of a warhead occurs. 4. The moored mine of claim 3 wherein the automatic timing device provided gives a first signal that deploys the parachute and a second subsequent signal that actuates a release mechanism that cuts away and releases the parachute after the trajectory of the mine has been altered from horizontal to substantially vertical by the use of an air braking means. 5. The moored mine of claim 4 wherein an automatic timing device ignites the propulsion means at a time subsequent to ice penetration by the moored mine. 6. The moored mine of claim 5 wherein the propulsion means comprises a rocket motor.

* * * * *